US008616727B2

(12) United States Patent
Hisayasu et al.

(10) Patent No.: US 8,616,727 B2
(45) Date of Patent: Dec. 31, 2013

(54) BULB-TYPE LED LAMP HAVING A WIDENED LUMINOUS DISTRIBUTION VIA A FASTENED WAVEGUIDE

(75) Inventors: Takeshi Hisayasu, Yokosuka (JP); Daigo Suzuki, Yokohama (JP)

(73) Assignee: Toshiba Lighting & Technology Corporation, Kanagawa (JP)

( * ) Notice: Subject to any disclaimer, the term of this patent is extended or adjusted under 35 U.S.C. 154(b) by 0 days.

(21) Appl. No.: 13/416,951

(22) Filed: Mar. 9, 2012

(65) Prior Publication Data

US 2013/0027939 A1 Jan. 31, 2013

(30) Foreign Application Priority Data

Jul. 26, 2011 (JP) ..... 2011-163336

(51) Int. Cl.
*F21V 8/00* (2006.01)

(52) U.S. Cl.
USPC ..... 362/249.02; 362/800; 362/249.01; 313/504

(58) Field of Classification Search
CPC ..... F21V 8/00; H01L 31/14; G02B 6/0068; H05B 41/02
USPC ..... 313/498–512; 362/298–299, 249.2
See application file for complete search history.

(56) References Cited

U.S. PATENT DOCUMENTS

| | | | | |
|---|---|---|---|---|
| 2004/0085766 | A1 | 5/2004 | Chen et al. | |
| 2011/0194288 | A1 | 8/2011 | Hsu | |
| 2011/0286120 | A1* | 11/2011 | Harris | 359/827 |
| 2012/0236563 | A1* | 9/2012 | Breidenassel et al. | 362/249.02 |
| 2012/0243254 | A1* | 9/2012 | Frost et al. | 362/555 |

FOREIGN PATENT DOCUMENTS

| | | | |
|---|---|---|---|
| DE | 10-2008-016-496 | A1 | 10/2009 |
| DE | 10-2010-001-046 | A1 | 7/2011 |
| JP | 2006-156187 | | 6/2006 |
| JP | 2009-009870 | | 1/2009 |
| JP | 2010-062005 | | 3/2010 |

OTHER PUBLICATIONS

Morikawa et al., Japanese Patent Application 2010-062005, Mar. 2010 machine translation.*
International Search Report Patent Application No. 12158637.4 dated Jul. 11, 2013.

* cited by examiner

*Primary Examiner* — Tracie Y Green
(74) *Attorney, Agent, or Firm* — Patterson & Sheridan, LLP

(57) ABSTRACT

According to one embodiment, an LED lamp includes an LED module and a light guide. The LED module includes a plurality of LEDs annularly arranged and mounted on a front surface of a board, and an opening provided in the board at an inside surrounded by the LEDs. The light guide is engaged and fastened to the opening from the front surface side of the board. The light guide guides part of light emitted by the LEDs, and emits the light guided from the front surface side to a rear surface side over an outer edge part of the board.

9 Claims, 4 Drawing Sheets

BULB-TYPE LED LAMP HAVING A WIDENED LUMINOUS DISTRIBUTION VIA A FASTENED WAVEGUIDE

CROSS-REFERENCE TO RELATED APPLICATIONS

This application is based upon and claims the benefit of priority from prior Japanese Patent Application No. 2011-163336, filed Jul. 26, 2011, the entire contents of which are incorporated herein by reference.

FIELD

Embodiments described herein relate generally to a bulb-type LED lamp including a cap for a bulb.

BACKGROUND

With the improvement of light-emitting efficiency, a light-emitting diode (LED) becomes adopted in a luminaire. Instead of an incandescent lamp using a filament as a light source, a bulb-type LED lamp using the LED as a light source becomes popular. The LED lamp includes a board on which the LED is mounted. In the LED lamp, since the LED as the light source is mounted on the flat board, a luminous intensity distribution angle of 180 degrees or more can not be obtained. Besides, since the light emitted by the LED has higher directionality than the light emitted by the filament of the incandescent lamp, the center of an irradiation field is bright and the periphery gives an impression of dimness.

In order to improve the luminous intensity distribution characteristics as stated above, an LED lamp is developed in which a board itself mounted with an LED is inclined to increase the amount of luminous intensity distribution to the side, or an LED lamp is developed which includes optical elements such as a prism and a lens or a reflecting plate.

In order to distribute light in a wide range, there is a case where plural boards mounted with LEDs are respectively arranged at different angles. The plural boards are required to be assembled three-dimensionally, and the respective boards must be cooled. When lighting-on and lighting-off are repeated, a temperature change occurs in the boards. When differences in the amount of heat expansion occur among the boards and cooling members thereof, there is a fear that the respective boards can not be uniformly cooled. For improvement of such problems, the structure becomes complicated and the manufacturing cost increases, and therefore, the improvement is hard to adopt.

Further, when the optical elements or the reflecting plate is attached in order to change the luminous intensity distribution characteristics, the efficiency of diffusing the light emitted by the LED must not be reduced. Besides, a shadow or unevenness of light due to the provision of these components must be prevented from occurring in a range of luminous intensity distribution. Accordingly, the range in which the optical element or the reflecting plate can be attached is limited. In the related art technique, the optical element or the reflecting plate is directly fastened to the board by a screw or is bonded by an adhesive. However, it is not preferable because the number of parts increases when the optical element or the reflecting plate is fastened to the board by the screw. Besides, when the optical element or the reflecting plate is bonded to the board by the adhesive, a shear force is applied to the bonding surface due to a difference between the coefficient of linear expansion of the board and the coefficient of linear expansion of the optical element or the reflecting plate. The service life of the LED as the light source is remarkably longer than the service life of the filament of the incandescent lamp, and as a result, the LED lamp is expected to be used for ten or more years. Thus, since the adhesive deteriorates over time, and the shear force is repeatedly applied, there is a fear that the adhesive surface is peeled or the adhesive part is damaged at the ending of the service life of the LED lamp.

DETAILED DESCRIPTION

In general, according to one embodiment, an LED lamp is provided that the number of parts is not increased when an optical member to widen a luminous intensity distribution angle of an LED is attached, and has a structure which is not damaged before the service life of the LED expires. According to one embodiment, an LED lamp includes an LED module and a light guide. The LED module includes a plurality of LEDs annularly arranged and mounted on a front surface of a board, and an opening provided in the board at an inside surrounded by the LEDs. The light guide is engaged and fastened to the opening from the front surface side of the board. The light guide guides part of light emitted by the LEDs, and emits the light guided from the front surface side to a rear surface side over an outer edge part of the board.

According to another embodiment, an LED lamp includes an LED module, a base body, a globe and a light guide. The LED module includes a plurality of LEDs annularly arranged and mounted on a board. A connector to supply power to the LEDs is arranged on the board inside the annularly arranged LEDs. The board has an opening through which a plug to be connected to the connector passes. The base body is thermally connected to the LED module, and releases heat generated by the LEDs. The globe is formed into a dome shape and is attached to cover the LED module. The light guide is engaged and fastened to the opening from a front surface side of the board on which the LEDs are mounted. The light guide guides part of light emitted by the LEDs, and emits the light guided from the front surface side to a rear surface side over an outer edge part of the board.

Figure 1:
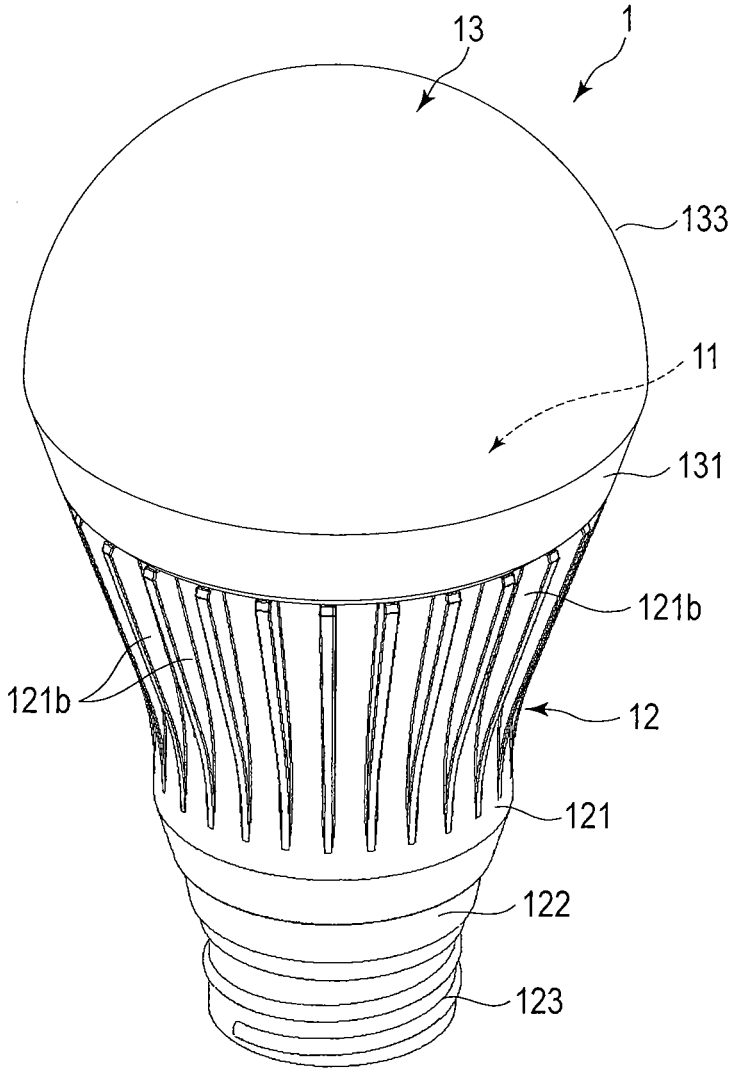
FIG. 1 is a perspective view showing an LED lamp of an embodiment.

An LED lamp 1 of an embodiment will be described with reference to FIG. 1 through FIG. 4. The LED lamp 1 shown in FIG. 1 is an LED lamp having a so-called bulb-type outer appearance. In the specification, the "LED" includes a light-emitting device in addition to a light-emitting diode. The LED lamp 1 includes an LED module 11, a base body 12, a globe 13 and a light guide 14, as shown in FIG. 2.

Figure 2:
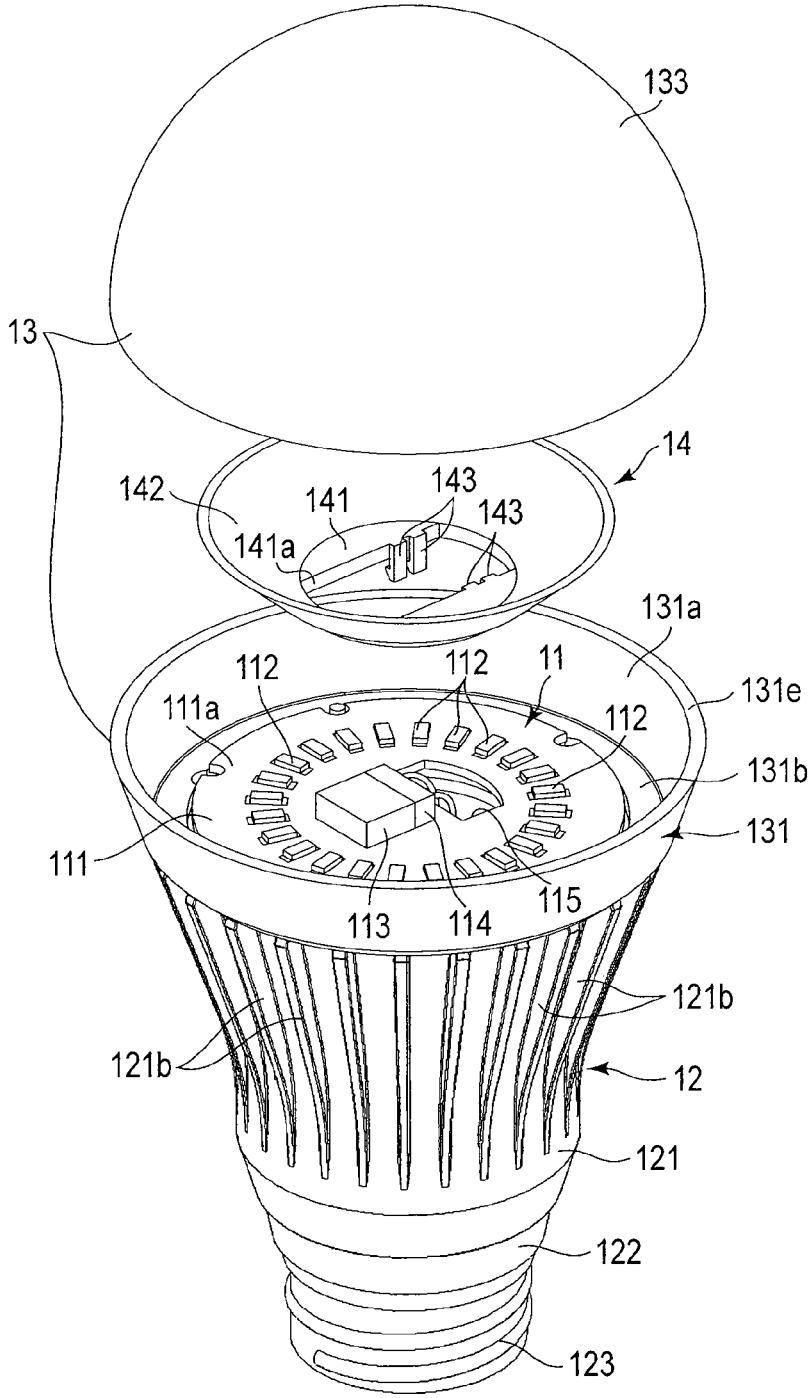
FIG. 2 is an exploded perspective view of the LED lamp shown in FIG. 1.

The LED module 11 as shown in FIG. 2 includes a board 111 formed into a circular disk shape, a plurality LEDs 112 annularly mounted and mounted on the board, a connector 113 arranged at the center of the board 111 to supply power to the LEDs 112, and an opening 115 through which a plug 114 to be connected to the connector passes. The 24 LEDs 112 are arranged at equal intervals and concentrically with respect to the center of the board 111.

The connector 113 is settled inside the annularly arranged LEDs 112 and at a position eccentric from the center of the board 111. The opening 115 is provided in the vicinity of the position where the connector 113 is placed. The plug 114 is connected to a control board arranged inside the base body 12. The control board is provided with a power supply circuit and a lighting circuit.

Figure 3:
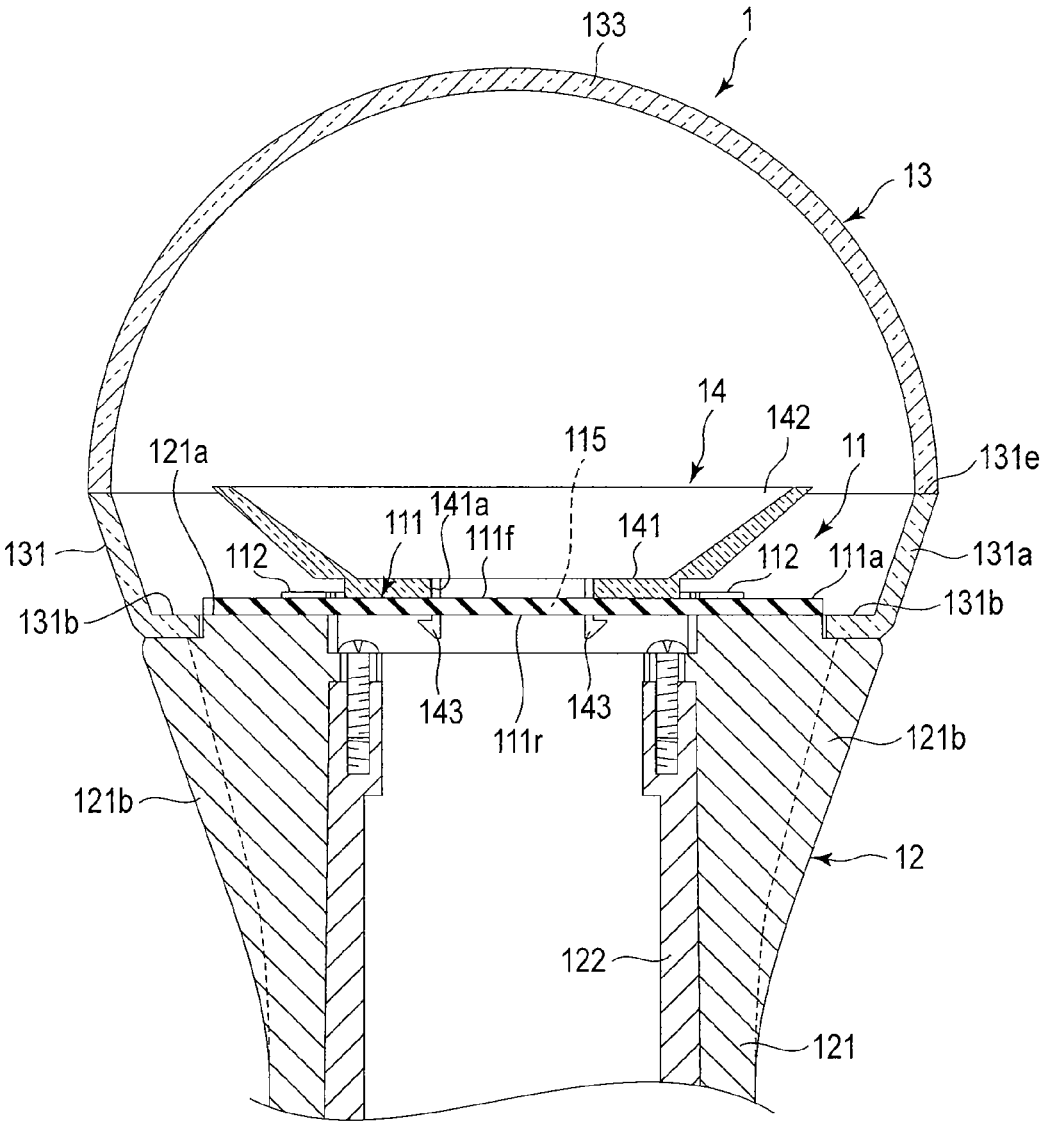
FIG. 3 is a sectional view passing through the center of the LED lamp directed to an opening side of a board shown in FIG. 2.

The base body 12, as shown in FIG. 2, includes a thermal radiator 121, an insulating member 122 and a cap 123. The thermal radiator 121 is a member excellent in thermal conductivity such as a die-cast part of aluminum alloy in this embodiment, and includes a contact surface 121*a* thermally connected to the LED module 11 as shown in FIG. 3. The contact surface 121*a* has at least a sufficient area to contact the board 111 in the range where the LEDs 112 are mounted. The thermal radiator 121 includes fins 121*b* for thermal radiation at equal intervals on the outside surface in order to release heat generated by the LEDs 112. The insulating member 122 is made of a non-conductive member such as synthetic resin. The insulating member 122 is inserted in the thermal radiator 121, and is fastened by a screw as shown in FIG. 3. The control board to control lighting-on and lighting-off of the LEDs 112 is held inside the insulating member 122. The cap 123 is formed to fit a socket for an incandescent lamp, and is insulated from the thermal radiator 121 by the insulating member 122. The cap 123 is connected to the power supply circuit of the control board.

The globe 13, as shown in FIG. 3, is formed into a dome shape, and is attached to cover the LED module 11. The globe 13 includes a base 131 and a dome portion 133. The base 131 is formed to surround the outer periphery of the LED module 11, and includes a side wall 131*a* along a conical surface passing through the tips of the fins 121*b* of the thermal radiator 121, and a flange 131*b* extending inward in parallel to the contact surface 121*a* and fastened to the thermal radiator 121, as shown in FIG. 2 and FIG. 3. The dome portion 133 is joined to an edge 131*e* of the base 131 at the opposite side to the side where the flange 131*b* is provided. In this embodiment, the dome portion 133 is formed to be substantially hemispherical. According to the material and a manufacturing process of the globe 13 formed of synthetic resin by injection molding, the spherical surface may be a slightly incomplete hemisphere or may be a spherical surface integrally molded to a position exceeding a great circle. The dome portion 133 is fusion-joined to the edge 131*e* of the base 131 by ultrasonic joining or laser joining.

Figure 4:
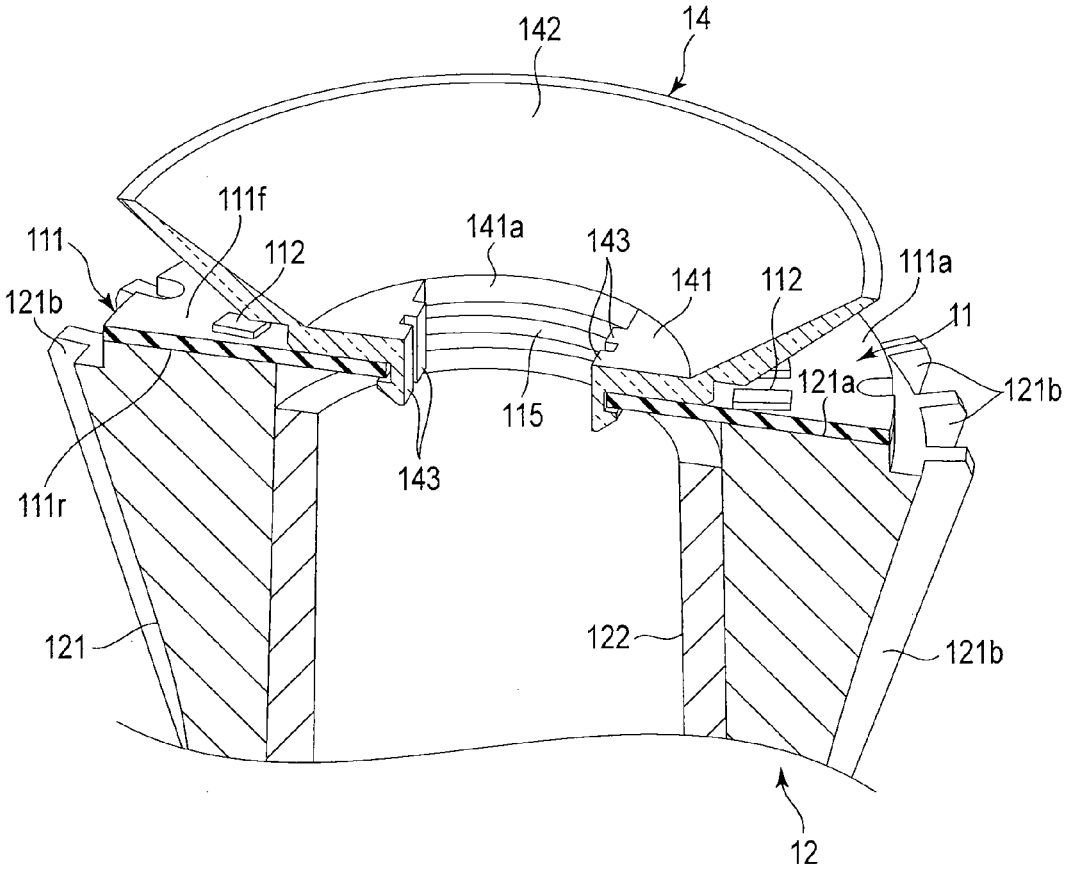
FIG. 4 is a sectional view along an edge at a connector side of the opening of the board shown in FIG. 2.

The light guide 14 includes a base portion 141, a light leading portion 142 and hooks 143, as shown in FIG. 2 and FIG. 3. The base portion 141 contacts a front surface 111*f* of the board 111 at a region in a range inside the annularly arranged LEDs 112 except for a range of the connector 113 and the opening 115, as shown in FIG. 3 and FIG. 4. The light leading portion 142 as shown in FIG. 3 is connected integrally with a corner of the outer periphery of the base portion 141, and extends toward the outer periphery of the board 111 in a direction of separating from the board 111. Incidentally, the shape and principle of the light leading portion 142 is not limited to the shape shown in FIG. 2 to FIG. 4 as long as part of the light emitted from the LEDs 112 is emitted from the front surface 111*f* side to a rear surface 111*r* side over an outer edge part 111*a* of the board 111, and the luminous intensity distribution angle of the LED lamp 1 can be widened.

The hooks 143 shown in FIG. 3 and FIG. 4 are formed continuously with the base part 141 at a position corresponding to an edge of the opening 115 of the board 111, and extend from the front surface 111*f* side of the board 111 to the rear surface 111*r* side through the opening 115. At least one hook 143 is arranged at each of positions symmetrical with respect to the center of the opening 115, and in this embodiment, two hooks 143 are arranged at each of the positions as shown in FIG. 2 and FIG. 4.

In the state where the light guide 14 is in close contact with the board 111 as shown in FIG. 3, the tips of the hooks 143 are slightly separate from the rear surface 111*r* of the board 111. Besides, a slight gap is provided between each of the hooks 143 and an edge of the opening 115 in the direction along the front surface 111*f* of the board 111 as shown in FIG. 4. If nothing is done in this state, rattling occurs between the board 111 and the light guide 14. Thus, a place of the base portion 141 except the hooks 143, for example, a through-hole 141*a* provided in the base portion 141 correspondingly to the connector 113 and the opening 115 may be connected to the front surface 111*f* of the board 111 by an adhesive.

In the LED lamp 1 as constructed above, the light guide 14 is engaged and fastened by the hooks 143. Therefore, a minute part such as a screw is not required. Besides, the hooks 143 are bent only when the light guide 14 is assembled to the board 111 of the LED module 11, and in the state where the light guide 14 is fitted to the opening 115 of the LED module 11, the gap is provided between each of the hooks 143 and the edge of the opening 115. As a result, during the use of the LED lamp 1, even if repetition of lighting-on and lighting-off causes that the temperature of the hooks 143 and the board 111 are repeatedly changed, a stress is not repeatedly applied to the hooks 143 themself. Hence, the light guide 14 maintains the normally held state and does not drop from the LED module 11 before the ending of the service life of the LED. The light guide 14 does not drop because the hooks 143 engage with the board 111, even if the adhesive used to suppress the rattling is deteriorated and is peeled.

Besides, the hooks 143 to engage and fasten the light guide 14 to the board 111 are fitted to the edge of the opening 115 formed in the board and inside the portion where the LEDs 112 are annularly arranged. A dimensional change in the vicinity of the center of the board 111 is small even if the board 111 is expanded by heat of the LEDs 112. Further, the edge of the opening 115 expands in the direction of leaving from the hook 143 when the board 111 expands. Therefore, the gap between each of the hooks 143 and the opening 115 may not need and be substantially zero.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An LED lamp comprising:

an LED module including a board and a plurality of LEDs annularly arranged and mounted on a front surface of the board, the board having an opening at an area of the board surrounded by the LEDs; and a light guide including a base portion and a light leading portion integrated with the base portion and extending from the base portion toward an outer periphery of the board and in a direction away from the front surface of the board, the light guide being engaged with and fastened to the front surface side of the board at the opening, and being configured to guide a part of light emitted by the LEDs through the light leading portion and a part of the light emitted by the LEDs over an outer edge of the board.

2. The LED lamp of claim 1, wherein the light guide includes a hook portion engaged with an edge of the board defining the opening.

3. The LED lamp of claim 2, wherein a gap is formed between the hook portion and the edge of the board defining the opening in a direction along the front surface of the board.

4. The LED lamp of claim 2, wherein the hook portion has at least two hooks are arranged at positions symmetrical with each other with respect to a center of the opening.

5. The LED lamp of claim 1, wherein the LED module includes a connector arranged on the board at the area of the board surrounded by the LEDs, and the connector is connected to a plug passing through the opening.

6. The LED lamp of claim 1, further comprising:

a base body configured to be thermally connected to the LED module and to release heat generated by the LEDs.

7. The LED lamp of claim 6, wherein the base body has a contact surface configured to cover at least an area in the rear surface of the board corresponding to an area on which the LEDs are mounted.

8. The LED lamp of claim 1, wherein the light guide is made of a transparent material.

9. The LED lamp of claim 1, wherein the LED module further includes a connector disposed at the area of the board surrounded by the LEDs, and the base portion of the light guide is disposed between the LEDs and the connector.

* * * * *